US008528394B2

(12) United States Patent
Eriksen

(10) Patent No.: US 8,528,394 B2
(45) Date of Patent: Sep. 10, 2013

(54) ASSEMBLY AND METHOD FOR TRANSIENT AND CONTINUOUS TESTING OF AN OPEN PORTION OF A WELL BORE

(75) Inventor: Kåre Otto Eriksen, Stavanger (NO)

(73) Assignee: Statoil ASA, Stavanger (NO)

( * ) Notice: Subject to any disclaimer, the term of this patent is extended or adjusted under 35 U.S.C. 154(b) by 544 days.

(21) Appl. No.: 12/526,352

(22) PCT Filed: Feb. 14, 2008

(86) PCT No.: PCT/NO2008/000058

§ 371 (c)(1),
(2), (4) Date: Jul. 7, 2010

(87) PCT Pub. No.: WO2008/100156

PCT Pub. Date: Aug. 21, 2008

(65) Prior Publication Data

US 2010/0294033 A1 Nov. 25, 2010

(30) Foreign Application Priority Data

Feb. 14, 2007 (NO) ..... 20070851

(51) Int. Cl.
*E21B 47/00* (2012.01)
*E21B 47/10* (2012.01)
*E21B 49/00* (2006.01)

(52) U.S. Cl.
USPC ..... 73/152.04; 73/152.19; 73/152.23

(58) Field of Classification Search
USPC ..... 73/152.03, 152.04, 152.19, 152.23, 73/152.28, 152.43; 166/264, 147, 106, 266, 166/271, 100, 250.07
See application file for complete search history.

(56) References Cited

U.S. PATENT DOCUMENTS

| | | | |
|---|---|---|---|
| 5,337,821 | A | 8/1994 | Peterson |
| 5,799,733 | A | 9/1998 | Ringgenberg et al. |
| 6,352,110 | B1 | 3/2002 | Langseth et al. |
| 6,655,457 | B1 | 12/2003 | Dybdahl |

FOREIGN PATENT DOCUMENTS

| | | |
|---|---|---|
| EP | 0046651 | 3/1982 |
| EP | 1264962 | 12/2002 |
| GB | 2297571 | 8/1996 |
| GB | 2355033 | 4/2001 |

*Primary Examiner* — Daniel Larkin
*Assistant Examiner* — Jamar Ray
(74) *Attorney, Agent, or Firm* — Volpe and Koenig, P.C.

(57) ABSTRACT

An assembly for transient and continuous testing of an open portion of a well bore arranged in a lower part of a drill string includes at least two packers fixed outside of the drill string, which are expandable for isolating a reservoir interval. The assembly includes a down-hole pump, sample chamber, sensors, closing valve, sensors and telemetry for measuring and realtime transmission of flow rate, pressure and temperature of fluid flow from the reservoir interval, from the down-hole pump, in the drill string and in an annulus above the packers, a mud driven turbine or electric cable, and a circulation unit. The circulation unit, independent of the circulation rate for mud to the annulus, can feed formation fluid from the reservoir interval into the annulus, so that at any time a well can be kept in over balance and the mud can solve the formation fluid from the reservoir interval.

25 Claims, 6 Drawing Sheets

FTWT Job Sequence 1:

FTWT Job Sequence 2:

FTWT Job Sequence 3:

FTWT Job Sequence 4:

FTWT Job Sequence 5:

FTWT Job Sequence 6:

FTWT Job Sequence 7:

ASSEMBLY AND METHOD FOR TRANSIENT AND CONTINUOUS TESTING OF AN OPEN PORTION OF A WELL BORE

SCOPE OF INVENTION

The present invention relates to testing of oil and gas wells. More specifically, the invention relates to an assembly and a method for transient and continuous testing of an open portion of a well bore.

PRIOR ART AND BACKGROUND OF THE INVENTION

The testing of oil and gas wells is of great importance for determining reservoir properties and production capacity of a hydrocarbon containing reservoir. Such testing is preferably made with a drill string, during so-called drill string testing (DST), during which a zone of interest is isolated by temporary packers, so that fluid from the reservoir zone may flow into the space between said packers.

U.S. Pat. No. 5,799,733 discloses a down-hole tool for early evaluation of a reservoir, primarily for taking samples of open-hole reservoir fluid. In said publication is described inflatable packer elements for isolating an open-hole reservoir interval of interest, a down-hole pump driven electrically or by a mud motor and providing a mud return to a drill string/test string or the annulus above the packers, and further are described a sample chamber and sensors for the measurement of fluid properties. Technology enabling an extended testing like the continuous mixing of mud and reservoir fluid during controlled conditions is however not disclosed, but several places give warnings against the risk for loss of pressure control, see for example column 16, lines 33-42 in U.S. Pat. No. 5,799,733. For embodiments having an electrically driven pump the formation fluid is fed to a well bore test string in order to eliminate the risk for loss of pressure control. For embodiments having a mud pump it is not possible to feed formation fluid into the upper part of a drill or test string, and for all such embodiments severe warnings are expressed against the risk of losing pressure control.

There is a demand for an assembly and a method for transient and continuous testing of an open portion of a well bore, without the above-mentioned limitations.

SUMMARY OF THE INVENTION

Aspects and preferred features of the present invention are set out in the appended claims.

The present invention is providing an assembly for transient and continuous, testing of an open portion of a well bore, said assembly being arranged in a lower part of a drill string, and is comprising:

- a minimum of two packers fixed at the outside of the drill string, said packers being expandable for isolating a reservoir interval,
- a down-hole pump for pumping formation fluid from said reservoir interval,
- a sample chamber,
- sensors for measuring fluid properties,
- a closing valve for closing the fluid flow from said reservoir interval, distinguished in that said assembly further is comprising:
- sensors and telemetry for measuring and real-time transmission of flow rate, pressure and temperature of the fluid flow from said reservoir interval, from said down-hole pump in the drill string and in an annulus above the packers,
- a mud driven turbine or electric cable for energy supply to said down-hole pump, and
- a circulation unit for mud circulation from a drill pipe to said annulus above the packers and feeding formation fluid from said down-hole pump to said annulus, said circulation unit, independent of the circulation rate of mud to said annulus can feed formation fluid from said reservoir interval into said annulus, so that a well at any time can be kept in over balance and so that the mud in said annulus at any time can dissolve the formation fluid from said reservoir interval.

The present invention also provides a method for transient and continuous testing of an open portion of a well bore, employing the assembly according to the invention and arranged in the lower part of a drill string, whereby continuous testing is carried out by feeding formation fluid into the annulus above the packers isolating a reservoir interval, while transient testing is carried out by closing the formation fluid flow and measuring the response as a function of time, the method comprising:

controlling said circulation unit based upon measured unit based upon measured data, the density and the reservoir fluid solubility of the mud, so that the well at any time is kept in over balance and said mud at any time can dissolve the reservoir fluid fed into said mud.

The present invention enables the testing of the production properties of a reservoir without using surface process equipment. Well testing is carried out in an open hole without the use of casing, meaning saving time. Further testing can be done independently in an unlimited number of test zones without having to trip in and out of the well bore, which gives a considerable cost and time saving. There is no need for conventional sub-surface test equipment for providing well control. Open-hole testing is possible without limitations regarding flow rate and duration. The pumping of reservoir fluid from a reservoir to the well can be done at a high flow rate, at great pump capacity, with large quantity of mud dissolved, which opens for testing of high permeability reservoirs. The testing is carried out in an open well and having all well control barriers in place, that is having weighted mud in the drill string and annulus at full over balance, as well as blow-out preventer (BOP) and down-hole closing valve above the packer elements. Preferably the assembly comprises a connection line for pressure communication over/under packer(s) to maintain the hydrostatic pressure, which means over balance, in the entire open hole. The assembly is preferably adapted for reducing well related noise and improve the differential pressure specifications, in particular by preferably using double packers over/under the test zone. Reservoir fluid is pumped out utilizing an electric or hydraulically driven pump. When using an electrical driven pump the pumping is always undertaken so as to provide a sufficient thinning or a complete dissolving of reservoir fluid in the drilling fluid by adjusting the flow rate so as to maintain a stable well, even during circulation stop. When using a hydraulically driven pump hydraulic energy is transformed to electric energy driving a hydraulic pump via a mud circulation turbine and generator. Alternatively, the hydraulic pump is driven by a hydraulic circuit in turn driven by a hydraulic mud circulation turbine, or a mud circulation turbine drives an electric pump. The flow rate thereby can be adjusted so that a stable well is maintained, even during circulation stops, independent of whether the pump is driven electrically or hydraulically. By controlling the input pumping of formation fluid based upon measured data, the mud density and the reservoir fluid solubility of the mud, the well thereby can be kept in over balance at any time and the mud can at any time dissolve the reservoir fluid fed into the mud.

The assembly comprises sensors for the measurement of chemical and physical properties of produced reservoir fluid, preferably chosen amongst sensors for or based upon optical spectroscopy, pH resistivity, gas/oil ratio, viscosity, and other sensor types known to the art. Additionally, the assembly comprises pressure and temperature meters for measuring pressure and temperature in the test zone, that is reservoir pressure and temperature, as well as the pressure and temperature in the pump, drill string and the annulus volume. The assembly comprises a circulation unit that is a flow diverter enabling controlled mud circulation from drill pipe to annulus at the same time as reservoir fluid from the down-hole pump is mixed with and dissolved in the mud, which makes it possible to produce a large volume of reservoir fluid without risking under balance or uncontrolled entering of reservoir fluid to the well. The assembly further comprises means for down-hole rate measurement and flow control. Further, the assembly comprises a closing valve that makes it possible to have an accurate closing of the well flow for the measuring of pressure response from the reservoir, that is transient testing. The assembly also comprises advantageously a telescope unit to take up expansion and contraction of the drill string or a set production packer (important for preventing displacement of packer elements and noise in pressure meters in the well test phase). The drill string comprises preferably a drill bit at the end of the assembly for hole conditioning before, between and after the formation testing. Natural gas coming from the mud/hydrocarbon solution at the return to the surface is fed through the mud conditioning equipment of the drilling installation and is vented to the air. Dissolved oil is accumulated in the mud and is left in the well in connection with the permanent return plugging after finished testing. Possible surplus mud can either be transported for destruction or reinjected to the reservoir. The present assembly and method advantageously make use of mud having a high solubility for reservoir fluid.

THE DRAWINGS

The present invention is illustrated by drawings, of which:

DETAILED DESCRIPTION

By the present invention open-hole testing is enabled, without using down-hole valves and surface processing equipment, while having unlimited flow time, unlimited flow volume and unlimited duration of closing. The features defined in the present claims make it possible to obtain such expanded flow rate and test duration without the risk for uncontrolled well blow-out.

Figure 2:
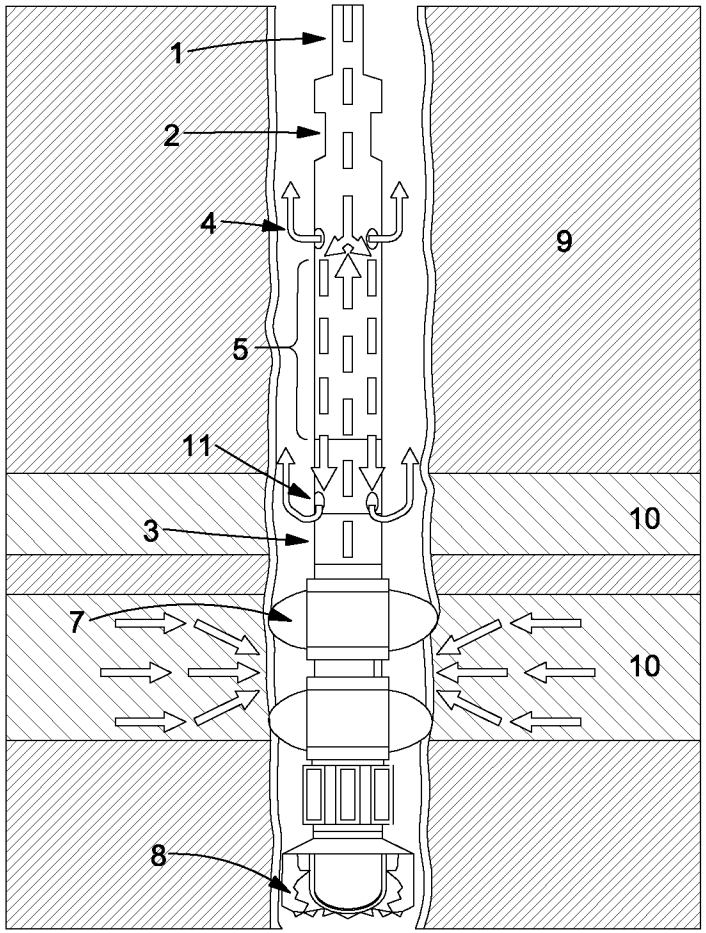
FIG. 2 illustrates an alternative assembly according to the invention.
Figure 1:
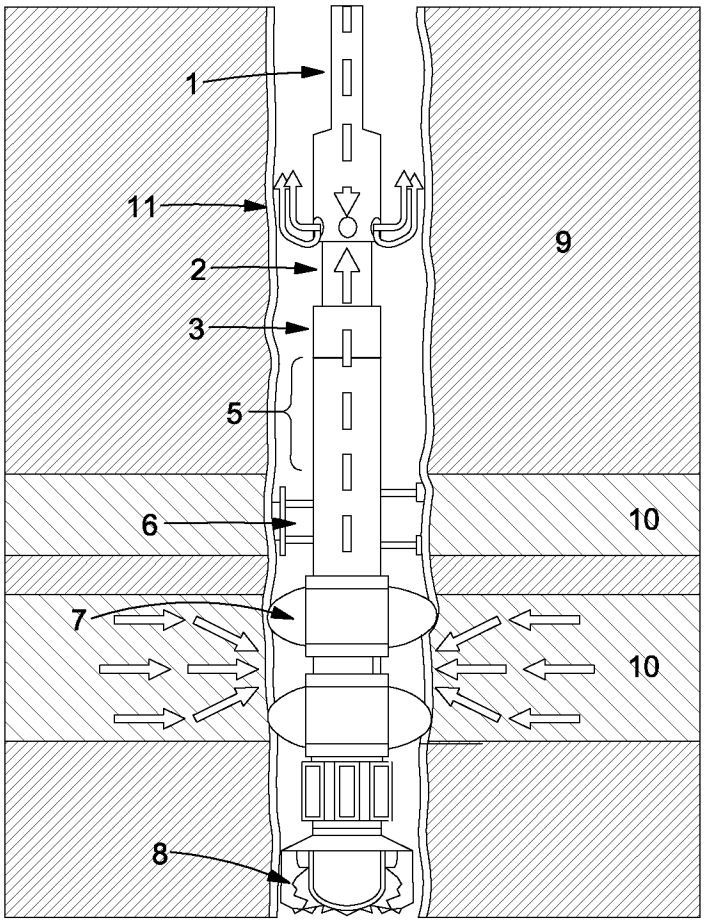
FIG. 1 illustrates an assembly according to the invention.

FIGS. 1 and 2 show two embodiments of the assembly according to the invention. In the embodiment of FIG. 1 pumped in reservoir fluid and circulated mud are introduced at the same level in the annulus over the packers, whereas the embodiment according to FIG. 2 illustrates introducing circulated mud and pumped in reservoir fluid into the annulus over the packers at different levels, as the circulation unit is arranged in a divided version. Other embodiments are also conceivable, but in any case the circulation unit is arranged so that circulated mud and pumped in formation fluid can be fed to the annulus over the packers under full control regarding the maintaining of overbalance and dissolving all the pumped in formation fluid in the mud.

Shown in FIGS. 1 and 2 are a drill pipe 1, a slip joint 2, a pump 3, a pump outlet 4, DFA tools and sample chambers 5, a probe 6, a straddle packer 7 with pressure gauge, a drill bit 8, shale 9, sand 10, and a flow diverter 11.

Figure 3:
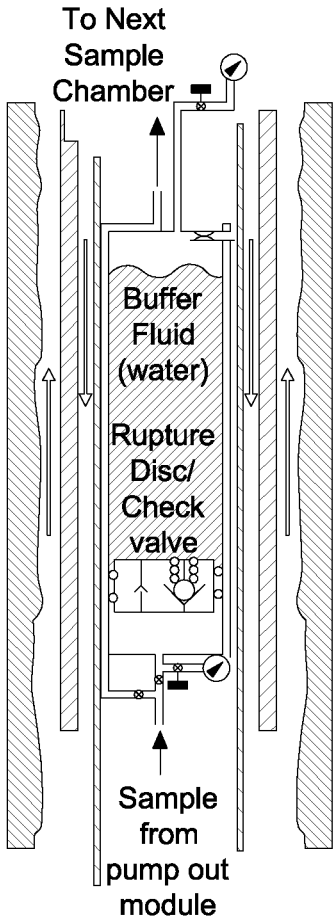
FIG. 3 illustrates a sampling chamber for use together with the assembly and the method according to the invention.
Figure 4:
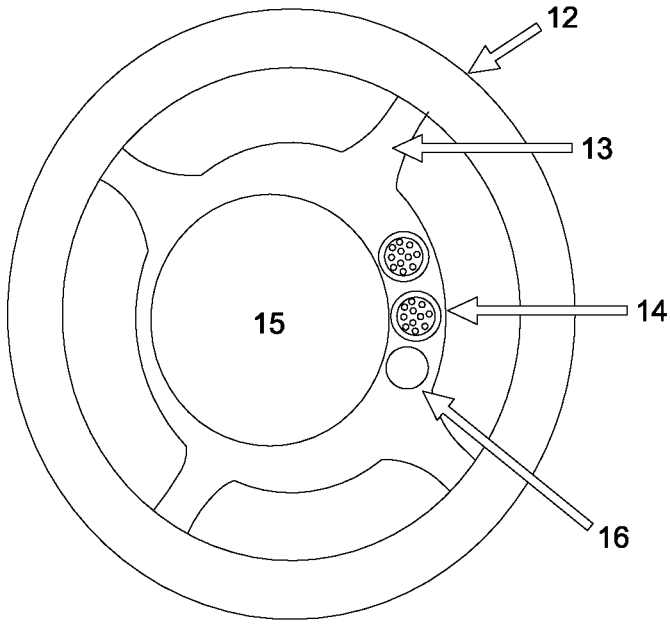
FIG. 4 illustrates a sampling chamber for use together with the assembly and the method according to the invention.

FIGS. 3 and 4 present a further illustration of a down-hole fluid analyser and a sample chamber (DFA).

The following are associated with the sample chambers of FIG. 3: Thin walled chamber ~75 liters/9 meters; Packaged in the 7" OD sleeve to provide circulation path; 'Smart Piston', self closing; Pressure release valves; Stackable; Hydraulic and electrical lines pass through/around chamber.

Shown in FIG. 4 are DFA & sample chambers 15, a 7 inch OD flow sleeve 12, centralisers 13, a tool wiring harness 14, and a sample flow line 16.

FIGS. 5 to 11 illustrate a drilling operation and a test carried out using a drill string having an assembly according to the invention. The sequence illustrated in FIGS. 5 to 11, with some explanatory text below, is self-evident for the persons skilled in the art.

Figure 5:
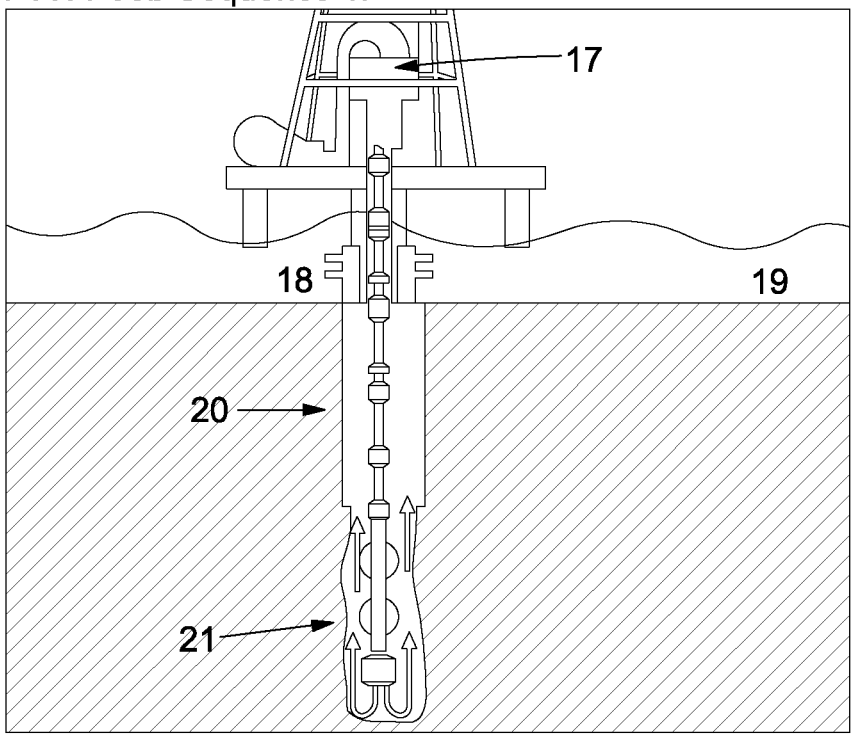
FIGS. 5 to 11 illustrate a sequence employing the assembly and the method according to the invention.

Shown in FIG. 5 are a top drive 17, BOP 18, sea bed 19, cased hole 20, and open hole 21. Shown in each of FIGS. 6 to 11 are a top drive 17, BOP 18, and sea bed 19.

Job Sequence 1 associated with FIG. 5 is as follows: Drill Well to TD; Perform openhole logging; RIH with FTWT; Circulate through the drill bit on bottom.

Figure 6:
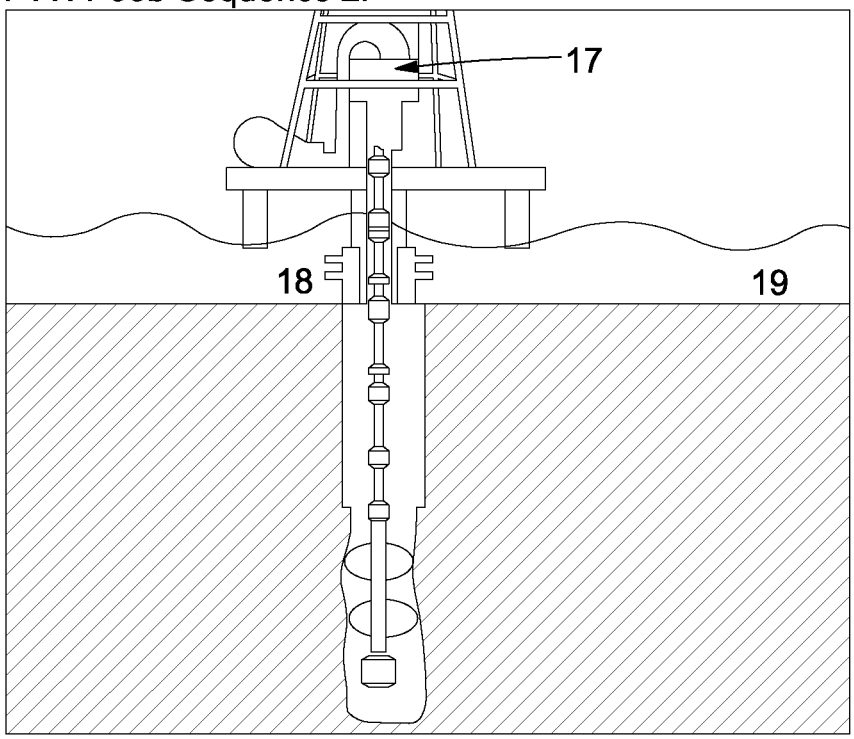
Figure 7:
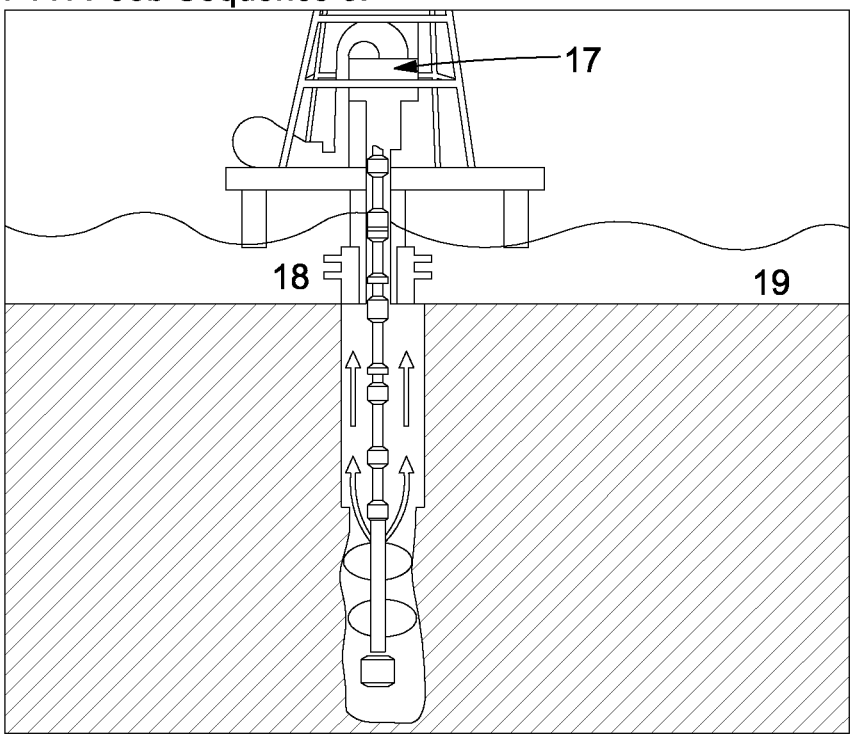

Job Sequence 2 associated with FIG. 6 is as follows: Fix tubing in BOP and Inflate FTWT packers Job Sequence 3 associated with FIG. 7 is as follows: Circulate above top packer.

Figure 8:
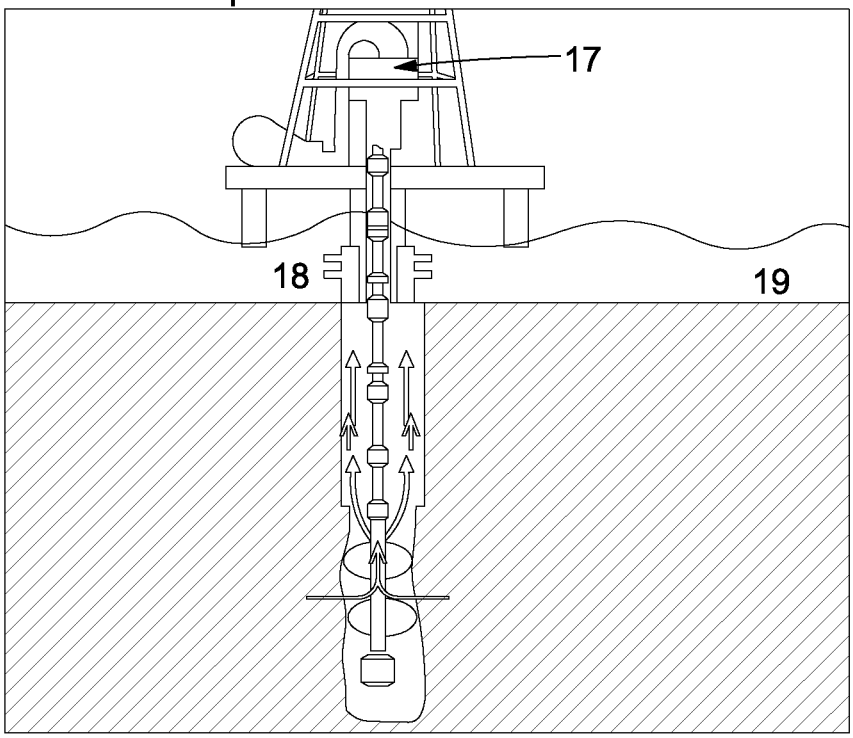

Job Sequence 4 associated with FIG. 8 is as follows: Isolate active mud system and pump out formation fluid from between packers to the annulus while continuing circulation with return through the kill and choke line through degasser.

Figure 9:
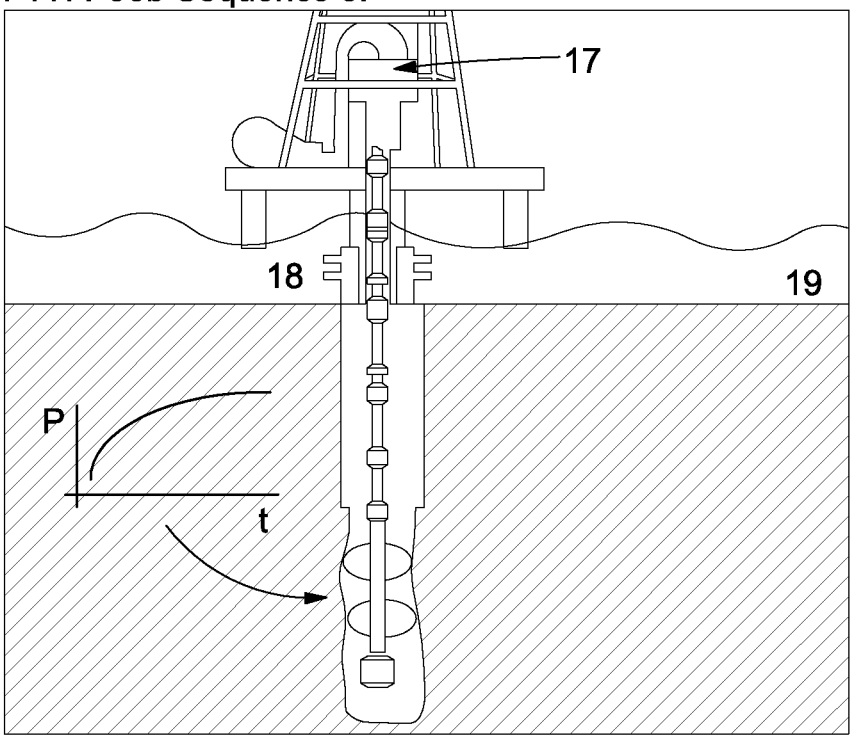

Job Sequence 5 associated with FIG. 9 is as follows: Stop circulation→Stop pumping out reservoir fluid; Measure pressure build up between packers for transient analysis.

Figure 10:
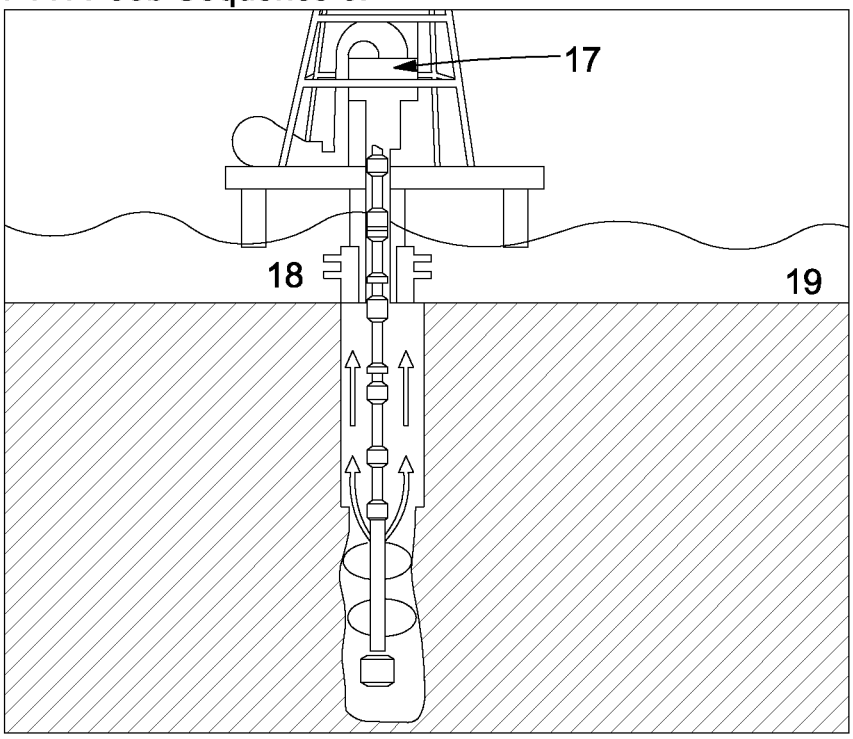

Job Sequence 6 associated with FIG. 10 is as follows: Circulate above top packer; Perform formation integrity test (optional).

Figure 11:
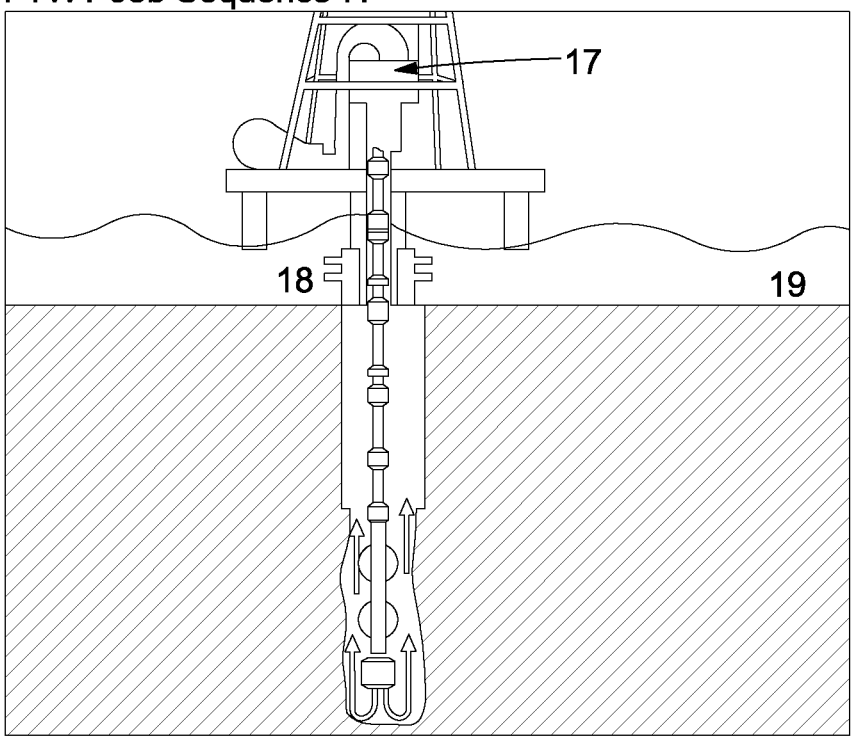

Job Sequence 7 associated with FIG. 11 is as follows: Deflate FTWT packers; Open BOP to unlock tubing; Circulate through the drill bit to condition well; Pull out of hole or go to next test zone.

The invention claimed is:

1. An assembly for transient and continuous testing of an open portion of a well bore, said assembly being arranged in a lower part of a drill string, and is comprising:

a minimum of two packers fixed at the outside of the drill string, said packers being expandable for isolating a reservoir interval, a down-hole pump for pumping formation fluid from said reservoir interval, a sample chamber, sensors for measuring fluid properties, a closing valve for closing fluid flow from said reservoir interval, characterised in that said assembly further is comprising:

sensors and telemetry for measuring and real-time transmission of flow rate, pressure and temperature of the fluid flow in or from each of four locations from said reservoir interval, from said down-hole pump, in the drill string and in an annulus above the packers, a mud driven turbine or electric cable for energy supply to said down-hole pump, and a circulation unit for mud circulation from a drill pipe to said annulus above the packers and for feeding formation fluid from said down-hole pump to said annulus, said circulation unit being operable to circulate mud to said annulus, and to feed formation fluid from said reservoir interval into said annulus, so that a well at any time can be kept in over balance and so that the mud in said annulus at any time can dissolve the formation fluid from said reservoir interval.

2. A method for transient and continuous testing of an open portion of a well bore, employing the assembly according to claim 1, arranged in the lower part of a drill string, in which method continuous testing is carried out by feeding formation fluid into the annulus above the packers isolating a reservoir interval, and transient testing is carried out by closing the formation fluid flow and measuring a response as a function of time, characterised by:

controlling said circulation unit based upon measured data, density of the mud and reservoir fluid solubility of the mud, so that the well at any time is kept in over balance and said mud at any time can dissolve the reservoir fluid fed into said mud.

3. An assembly for transient and continuous testing of an open portion of a well bore, the assembly being arranged in use in a lower part of a drill string, and comprising:

means for isolating a reservoir interval;

means for pumping formation fluid from the reservoir interval into an annulus above the isolating means;

means for measuring at least one property of the formation fluid from the reservoir interval, thereby enabling the continuous testing;

means for closing flow of formation fluid from the reservoir interval, thereby enabling the transient testing;

means for circulating mud from the drill string into the annulus; and means for controlling the flow of formation fluid from the reservoir interval into the annulus and flow of mud into the annulus so as to maintain an over balance condition in the well bore and so as to ensure that the mud in the annulus is sufficient to dissolve the formation fluid from the reservoir interval.

4. An assembly as claimed in claim 3, wherein the controlling means are arranged to control the flow in dependence on at least one of measured data, the density of the mud and the reservoir fluid solubility of the mud.

5. An assembly as claimed in claim 3, comprising means for measuring at least one property of the fluid flow from or in at least one or each of the reservoir interval, pumping means, the drill string and the annulus, and wherein the controlling means are arranged to control the flow in dependence on the measuring performed by the measuring means.

6. An assembly as claimed in claim 3, wherein the at least one property comprises at least one or each of flow rate, pressure and temperature.

7. An assembly as claimed in claim 3, wherein the at least one property comprises at least one of pH, resistivity, gas/oil ratio, and viscosity.

8. An assembly as claimed in claim 3, wherein the measuring means comprise a sample chamber.

9. An assembly as claimed in claim 3, wherein the isolating means are arranged or fixed outside the drill string.

10. An assembly as claimed in claim 3, wherein the isolating means comprise an expandable packer element.

11. An assembly as claimed in claim 3, wherein the isolating means comprise at least two expandable packers.

12. An assembly as claimed in claim 3, wherein the circulating and controlling means form part of a circulation unit.

13. An assembly as claimed in claim 3, wherein the pumping means comprise a down-hole pump for pumping formation fluid from the reservoir interval.

14. An assembly as claimed in claim 13, wherein the pump is an electric or hydraulically driven pump.

15. An assembly as claimed in claim 13, wherein the pumping means comprise means for feeding formation fluid from the pump into the annulus.

16. An assembly as claimed in claim 15, wherein the circulating and controlling means form part of a circulation unit and wherein the feeding means form part of the circulation unit.

17. An assembly as claimed in claim 3, wherein the measuring means comprise at least one sensor.

18. An assembly as claimed in claim 3, wherein the measuring means comprise a plurality of sensors.

19. An assembly as claimed in claim 3, wherein the measuring means are arranged to measure a plurality of properties of the fluid.

20. An assembly as claimed in claim 3, wherein the closing means comprise a closing valve.

21. An assembly as claimed in claim 3, comprising a mud-driven turbine or electric cable for energy supply to the pumping means.

22. An assembly as claimed in claim 3, comprising telemetry for real-time transmission of the at least one measured property.

23. An assembly as claimed in claim 3, wherein the over balance condition is maintained in a portion of the well bore in the annulus and/or the open portion of the well bore.

24. A method for transient and continuous testing of an open portion of a well bore, in which an assembly as claimed in claim 3 is arranged in the lower part of the drill string, in which continuous testing is performed by using the measuring means to measure the at least one property of the formation fluid from the reservoir interval, transient testing is performed by using the closing means to close the formation fluid flow and measuring a response as a function of time, and in which the controlling means are used to control the flow of formation fluid from the reservoir interval into the annulus and the flow of mud into the annulus so as to maintain an over balance condition in the well bore and so as to ensure that the mud in the annulus is sufficient to dissolve the formation fluid from the reservoir interval.

25. An assembly for transient and continuous testing of an open portion of a well bore, the assembly being arranged in use in a lower part of a drill string, and comprising:

an expandable packer element for isolating a reservoir interval;

a down-hole pump for pumping formation fluid from the reservoir interval into an annulus above the expandable packer element;

at least one sensor for measuring at least one property of the formation fluid from the reservoir interval, thereby enabling the continuous testing;

a closing valve for closing flow of formation fluid from the reservoir interval, thereby enabling the transient testing;

a circulation unit for circulating mud from the drill string into the annulus; and the circulating unit further controlling the flow of formation fluid from the reservoir interval into the annulus and flow of mud into the annulus so as to maintain an over balance condition in the well bore and so as to ensure that the mud in the annulus is sufficient to dissolve the formation fluid from the reservoir interval.

* * * * *